US005285635A

United States Patent [19]

Savelli et al.

[11] Patent Number: 5,285,635

[45] Date of Patent: Feb. 15, 1994

[54] DOUBLE ANNULAR COMBUSTOR

[75] Inventors: Joseph F. Savelli, West Chester; Byron A. Pritchard, Jr., Loveland, both of Ohio

[73] Assignee: General Electric Company, Cincinnati, Ohio

[21] Appl. No.: 81,482

[22] Filed: Jun. 22, 1993

Related U.S. Application Data

[63] Continuation of Ser. No. 859,759, Mar. 30, 1992, abandoned.

[51] Int. Cl.[5] ..... F02C 3/14; F23R 3/46

[52] U.S. Cl. ..... 60/39.36; 60/747

[58] Field of Search ..... 60/39.36, 747, 752, 60/753, 755, 756, 757, 748

[56] References Cited

U.S. PATENT DOCUMENTS

| | | | |
|---|---|---|---|
| 2,503,006 | 4/1950 | Stalker . | |
| 2,565,843 | 8/1951 | Dennison . | |
| 2,686,401 | 8/1954 | Newcomb | 60/39.36 |
| 2,996,884 | 8/1961 | Johnson et al. | 60/747 |
| 3,132,483 | 5/1964 | Lefebvre et al. | 60/747 |
| 4,194,358 | 3/1980 | Stenger | 60/39.06 |
| 5,054,280 | 10/1991 | Ishibashi et al. . | |

FOREIGN PATENT DOCUMENTS 0488557 6/1992 European Pat. Off. .

2003554 3/1979 United Kingdom .

OTHER PUBLICATIONS

Burrus, D. L., et al. "Energy Efficient Engine: Combustion System Component Technology Development Report", NASA R82AEB401. Nov., 1982. pp. 50, 287, 456, and 457.

*Primary Examiner*—Richard A. Bertsch
*Assistant Examiner*—Timothy S. Thorpe
*Attorney, Agent, or Firm*—James P. Davidson; Jerome C. Squillaro

[57] ABSTRACT

A double annular combustor having concentrically disposed inner and outer annular combustors is provided with inner and outer dome plates. Each dome plate has an inner portion and an outer portion. A cowl structure having an inner portion, an outer portion and a middle portion is also provided. The cowl outer portion is connected to the outer dome plate outer portion, the cowl inner portion is connected to the inner dome plate inner portion, and the cowl middle portion is connected to the outer dome plate inner portion and the inner dome plate outer portion. at an outer end, an inner end, and a middle portion. Additionally, the inner and outer annular combustors may lie in distinct radial planes, whereby the dome plate of the downstream annular combustor includes a section extending upstream to the cowl middle portion.

11 Claims, 4 Drawing Sheets

DOUBLE ANNULAR COMBUSTOR

This application is a continuation of application Ser. No. 07/859,759, filed Mar. 30, 1992 now abandoned.

BACKGROUND OF THE INVENTION

1. Field of the Invention

This invention relates generally to the combustion system of a gas turbine engine and, more particularly, to a double annular combustor having concentrically disposed inner and outer annular combustors with inner and outer dome plates, each dome plate having an inner portion and an outer portion, and a cowl structure having an inner portion, an outer portion, and a middle portion, wherein the cowl outer portion is connected to the outer dome plate outer portion, the cowl inner portion is connected to the inner dome plate inner portion, and the cowl middle portion is connected to the outer dome plate inner portion and the inner dome plate outer portion.

2. Description of Related Art

Efforts to reduce emissions in gas turbine engines have brought about the use of staged combustion techniques wherein one burner or set of burners is used for low speed, low temperature conditions such as idle, and another, or additional, burner or burners are used for high temperature operating conditions. One particular configuration of such a concept is that of the double annular combustor wherein the two stages are located concentrically in a single combustor liner. Conventionally, the pilot stage section is located concentrically outside and operates under low temperature and low fuel/air ratio conditions during engine idle operation. The main stage section, which is located concentrically inside, is later fueled and cross-ignited from the pilot stage to operate at the high temperature and relatively high fuel/air ratio conditions. The swirl cups of the respective pilot and main stage sections generally lie in the same radial and circumferential planes, as exemplified by U.S. Pat. No. 4,292,801 to Wilkes, et al. and U.S. Pat. Nos. 4,374,466 and 4,249,373 to Southern.

By contrast, however, a development report to the National Aeronautics and Space Administration (NASA) on combustion system component technology for the Energy Efficient Engine ($E^3$) discloses a double annular combustor configuration where the pilot stage (outer annular combustor) and the main stage (inner annular combustor) are radially offset (i.e., lie in distinct radial planes). U.S. Pat. No. 4,194,358 to Stenger also discloses a double annular combustor configuration where the inner and outer annular combustors are radially offset, but the pilot stage is placed in the radially inner portion of the combustor and the main stage section is placed in the radially outer portion thereof. In both the '358 patent and $E^3$ configurations, the effective length of the main stage section is relatively short and the effective length of the pilot stage section is relatively long. This configuration allows for complete or near-complete combustion to reduce the amount of hydrocarbon and carbon monoxide emissions since there is a relatively long residence time in the pilot stage section and a relatively minimal residence time in the main stage section.

Whether the inner and outer combustors are radially aligned or not, and whether the outer annular combustor acts as the pilot stage or main stage, the prior art discloses the use of a centerbody to isolate the pilot and main stages. The intended purpose of such centerbodies is to isolate the pilot stage from the main stage in order to ensure combustion stability of the pilot stage at various operating points and to allow primary dilution air to be directed into the pilot stage reaction zone. Such centerbody designs, however, require significant cooling airflows, and can interfere with the ability of the flame to jump from the pilot stage section to the main stage section as the engine power setting is increased and both stages are required. Accordingly, the present invention proposes an alternative arrangement which eliminates the centerbody between the pilot and main stages while maintaining the desirable characteristics thereof.

SUMMARY OF THE INVENTION

A double annular combustor having concentrically disposed inner and outer annular combustors is provided with inner and outer dome plates. Each dome plate has an inner portion and an outer portion. A cowl structure having an inner portion, an outer portion and a middle portion is also provided. The cowl outer portion is connected to the outer dome plate outer portion, the cowl inner portion is connected to the inner dome plate inner portion, and the cowl middle portion is connected to the outer dome plate inner portion and the inner dome plate outer portion. Additionally, the inner and outer annular combustors may lie in distinct radial planes, whereby the dome plate of the downstream annular combustor includes a section extending upstream to the cowl middle portion.

BRIEF DESCRIPTION OF THE DRAWINGS

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
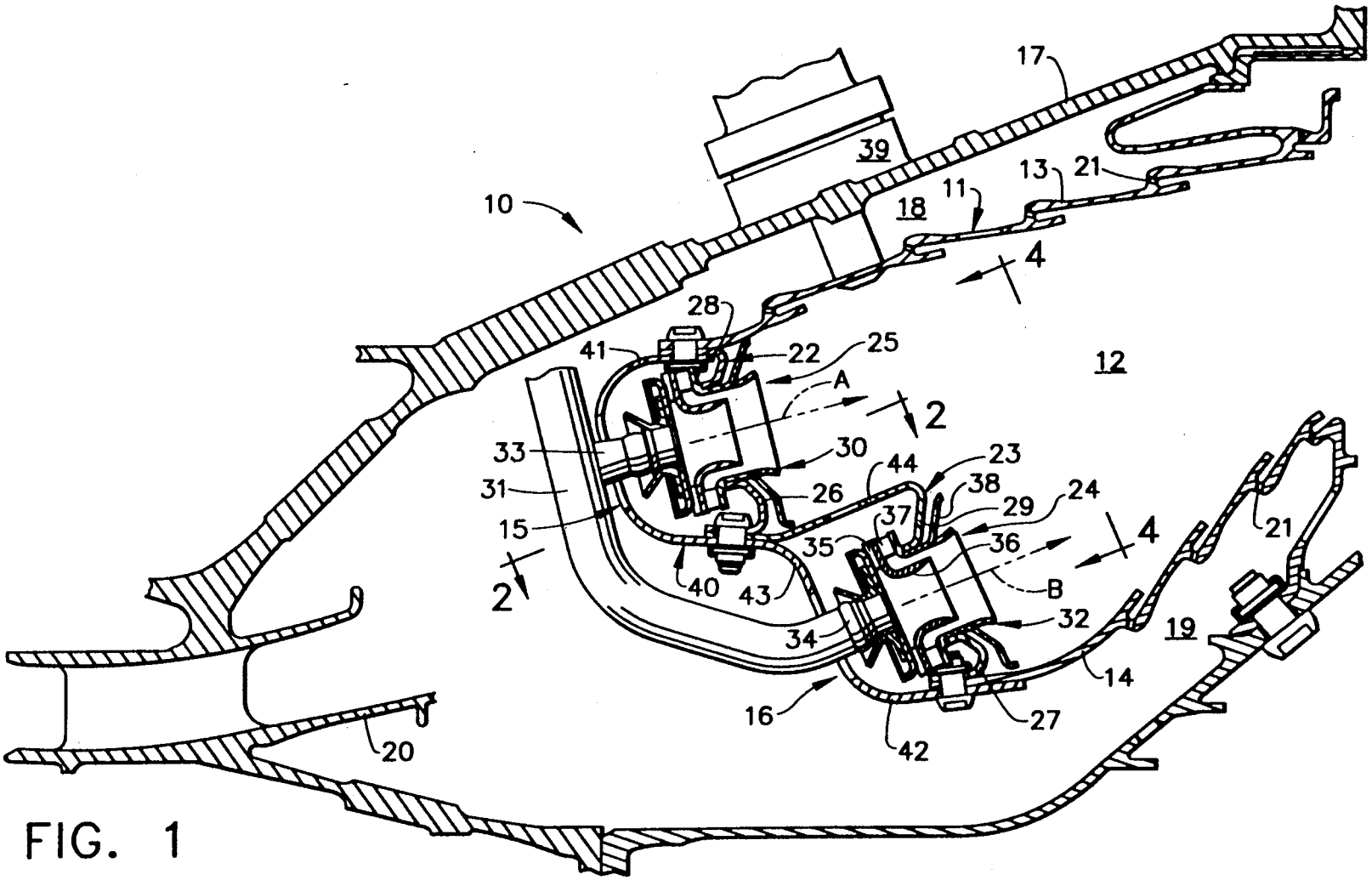
FIG. 1 is an axial cross-sectional view of a double annular combustor in accordance with a preferred embodiment of the invention.

Referring now to the drawings in detail, wherein identical numerals indicate the same elements throughout the Figures, FIG. 1 depicts a continuous-burning combustion apparatus 10 of the type suitable for use in a gas turbine engine and comprising a hollow body 11 defining a combustion chamber 12 therein. Hollow body 11 is generally annular in form and is comprised of an outer liner 13 and an inner liner 14. At the upstream end of the hollow body 11, is a pair of annular openings 15 and 16 for the introduction of air and fuel in a preferred manner as will be described hereinafter.

The hollow body 11 may be enclosed by a suitable shell 17 which, together with liners 13 and 14, defines outer passage 18 and inner passage 19, respectively, which are adapted to deliver in a downstream flow the pressurized air from a suitable source such as a compressor (not shown) and a diffuser 20. The compressed air from diffuser 20 passes principally into annular openings 15 and 16 to support combustion and partially to passages 18 and 19 where it is used to cool liners 13 and 14 by way of a plurality of apertures 21 and to cool the turbomachinery further downstream.

Disposed between and interconnecting outer and inner liners 13 and 14 near their upstream ends are outer and inner dome plates 22 and 23, respectively. Outer and inner dome plates 22 and 23 each have inner portions 26 and 27 and outer portions 28 and 29, respectively. Accordingly, outer dome plate outer portion 28 is connected to outer liner 13 and inner dome plate inner portion 27 is connected to inner liner 14.

Dome plates 22 and 23 are arranged in a so-called "double annular" configuration wherein the two form the forward boundaries of separate, radially spaced, annular combustors which act somewhat independently as separate combustors during various staging operations. For purposes of description, these annular combustor will be referred to as an inner annular combustor 24 having a centerline axis B and an outer annular combustor 25 having a centerline axis A, and will be more fully described hereinafter.

Disposed in outer dome plate 22 is a plurality of circumferentially spaced carburetor devices 30 with their axes being coincident with that of outer annular combustor 25 and aligned substantially with outer liner 13 to present an annular combustor profile which is substantially straight. It should be understood that carburetor device 30 can be of any of various designs which acts to mix or carburet the fuel and air for introduction into combustion chamber 12. One design might be that shown and described in U.S. Pat. No. 4,070,826, entitled "Low Pressure Fuel Injection System," by Stenger et al, and assigned to the assignee of the present invention. In general, carburetor device 30 receives fuel from a fuel tube 31 through fuel nozzle 33 and air from annular opening 15, with the fuel being atomized by the flow of air to present an atomized mist of fuel to combustion chamber 12.

In a manner similar to outer dome plate 22, inner dome plate 23 includes a plurality of circumferentially spaced carburetor devices 32 whose axes are aligned substantially parallel. To the axis of carburetor device 30 B of inner annular combustor 24. Carburetor devices 32, together with inner dome plate 23 and inner liner 14 define inner annular combustor 24 which may be operated substantially independently from outer annular combustor 25 as mentioned hereinbefore. Once again, the specific type and structure of carburetor device 32 is not important to the present invention, but should preferably be optimized for efficiency and low emissions performance. For description purposes only, and except for considerably higher airflow capacity, carburetor device 32 is identical to carburetor device 30 and includes a fuel nozzle 34 connected to fuel tube 31 for introducing fuel which is atomized by high pressure or introduced in a liquid state at a low pressure. A primary swirler 35 receives air from annular opening 16 to interact with the fuel and swirl it into venturi 36. A secondary swirler 37 then acts to present a swirl of air in the opposite direction so as to interact with the fuel/air mixture to further atomize the mixture and cause it to flow into combustion chamber 12. A flared splashplate 38 may be employed at the downstream end of carburetor device 32 so as to prevent excessive dispersion of the fuel/air mixture.

An igniter 39 is installed in outer liner 13 so as to provide ignition capability to outer annular combustor 25. As seen in FIG. 1, igniter 39 is positioned downstream of outer annular combustor 25 and substantially in line with the centerline of carburetor device 30.

Double annular combustor 10 does not include a centerbody, as found in the prior art, in order to reduce the mechanical complexity, the expense of manufacture, and the difficulty of effective cooling. Moreover, a centerbody may impede the ability to ignite the main stage from the pilot state (i.e., crossfire).

As depicted in FIG. 1, combustor 10 preferably includes a one-piece cowl structure 40 which has an outer portion 41, an inner portion 42, and a middle portion 43. As seen therein, outer portion 41 extends from a connection to outer portion 28 of outer dome plate 22 and outer liner 13 around carburetor device 30 to middle portion 43 located between outer annular combustor 25 and inner annular combustor 24. At this point, outer portion 29 of inner dome plate 23 and inner portion 26 of outer dome plate 22 are preferably connected to middle portion 43 by bolting or other similar means. Although inner dome plate outer portion 29 is shown as being sandwiched between outer dome plate inner portion 26 and middle portion 43, outer portion 29 and inner portion 26 may be separately connected to middle portion 43. It is also preferred that this connection occur substantially in-line with outer annular combustor 25. Cowl middle portion 43 is preferably curved, as shown in FIG. 1, to extend downs m from outer annular combustor 25 (i.e., parallel to axis A) to inner annular combustor 24 to accommodate the radial offset therebetween. Outer portion 29 is attached at its other end to splashplate 38 by brazing or other similar means.

Figure 2:
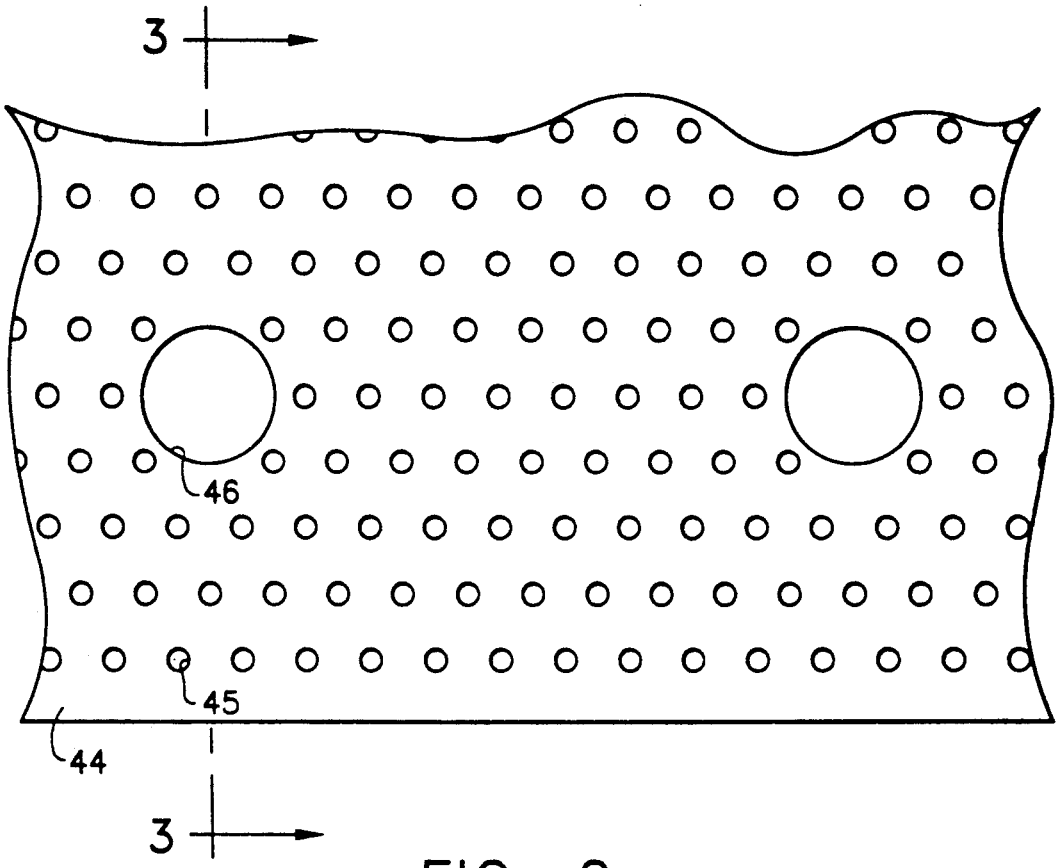
FIG. 2 is a partial top view of the extended section of the inner dome plate outer portion of FIG. 1 seen along 2—2 thereof.
Figure 3:
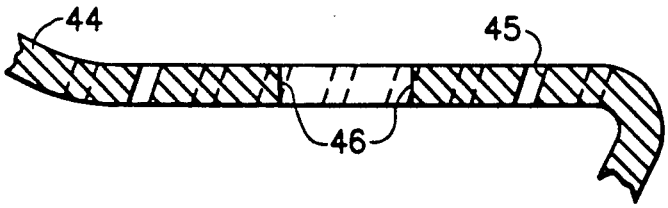
FIG. 3 is a partial transverse, cross-sectional view of the extended section of the inner dome plate outer portion of FIG. 2 seen along 3—3 thereof.
Figure 4:
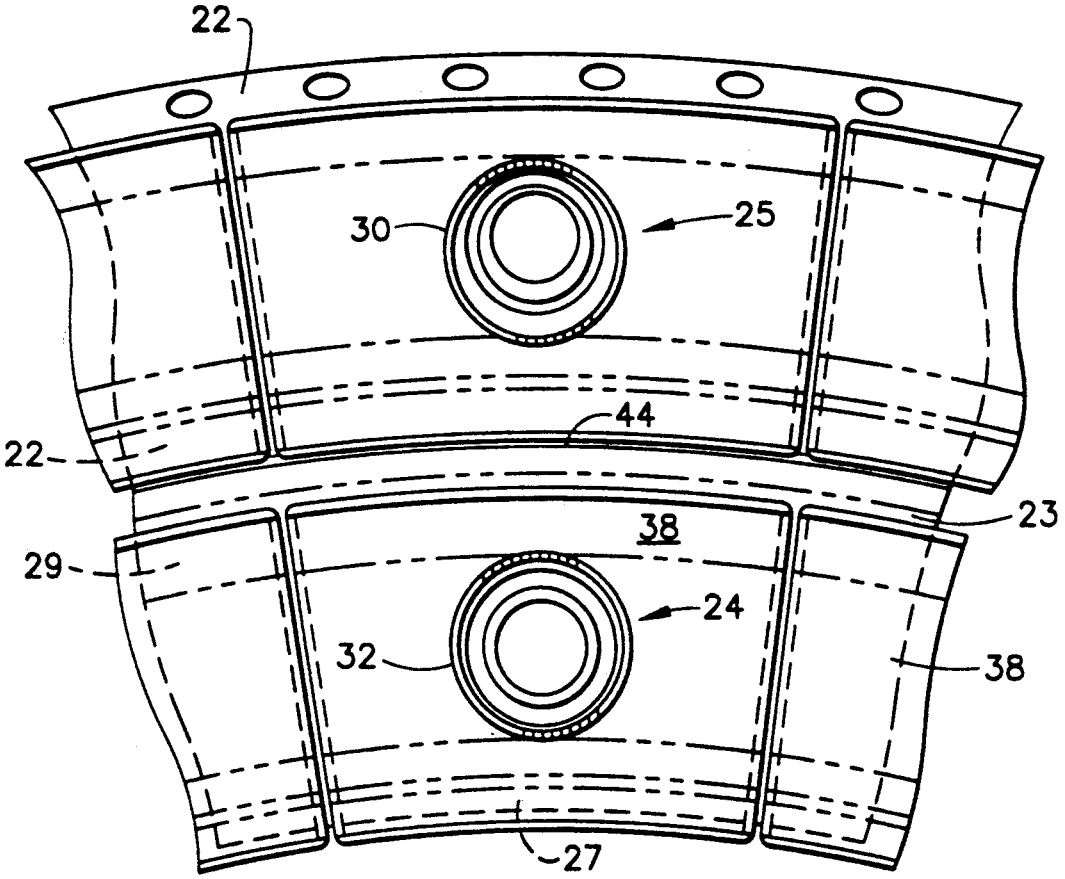
FIG. 4 is a transverse view of the double annular combustor of FIG. 1 seen along 4—4 thereof.

More specifically, outer portion 29 of inner dome plate 23 includes a section 44 which extends substantially parallel to axis B. As depicted in FIGS. 2 and 3, a plurality of cooling holes 45 are provided in section 44 to provide cooling to inner dome plate outer portion 29. Additionally, dilution holes 46 are also provided in section 44, which are substantially greater in size and substantially less in number to cooling holes 45. Inner portion 42 of cowl structure 40 is then connected to inner portion 27 of inner dome plate 22.

In this configuration, outer portion 29 of inner dome plate 22 is utilized to shelter the pilot stage, which helps to eliminate cold main stage air from quenching the combustion reaction in the pilot stage during pilot stage only operation, and thereby decrease low power gaseous emissions such as carbon monoxide and unburned hydrocarbons. The sheltered region also helps to establish a strong pilot stage recirculation zone to enhance pilot stage combustion stability and further reduce carbon monoxide and unburned hydrocarbons. Moreover, this design allows inner primary dilution air to be supplied to the pilot stage from behind the main stage with full dome pressure drop, whereby jet penetration is provided to better stabilize the pilot stage flame.

Considering now the operation of the above-described double annular combustor, outer annular combustor 25 and inner annular combustor 24 may be used individually or in combination to provide the desired combustion condition. Preferably, outer annular combustor 25 is used by itself for starting and low speed conditions and will be referred to as the pilot stage. The inner annular combustor 24 is used at higher speed, higher temperature conditions and will be referred to as the main stage combustor. Upon starting the engine and for idle condition operation, carburetor devices 30 are fueled by way of fuel tube 31, and the pilot stage is ignited by way of igniter 39. The air from diffuser 20 will flow both through active carburetor devices 30 and through inactive carburetor devices 32. During these idle conditions, wherein both the temperatures and airflow are relatively low, the pilot stage operates over a relatively narrow fuel/air ratio band and outer liner 13, which is in the direct axial line of carburetor devices 30, will see only narrow excursions in relatively cool temperature levels. This will allow the cooling flow distribution in apertures 21 to be maintained at a minimum. Further, because outer dome plate 22 and inner dome plate 23 lie in distinct axial planes, the pilot stage is relatively long as compared with the main stage and the residence time will preferably be relatively long to thereby minimize the amount of hydrocarbon and carbon monoxide emissions.

As the engine speed increases, fuel is introduced by fuel tube 31 to fuel nozzle 34 and thereafter into carburetor devices 32 so as to activate the main stage. During such higher speed operation, the pilot stage remains in operation but the main stage consumes the majority of the fuel and the air. It will be recognized that the main stage is axially short in length when compared with the pilot stage due to the axial offset therebetween, whereby the residence time will be relatively short to reduce the NOx emissions.

Figure 5:
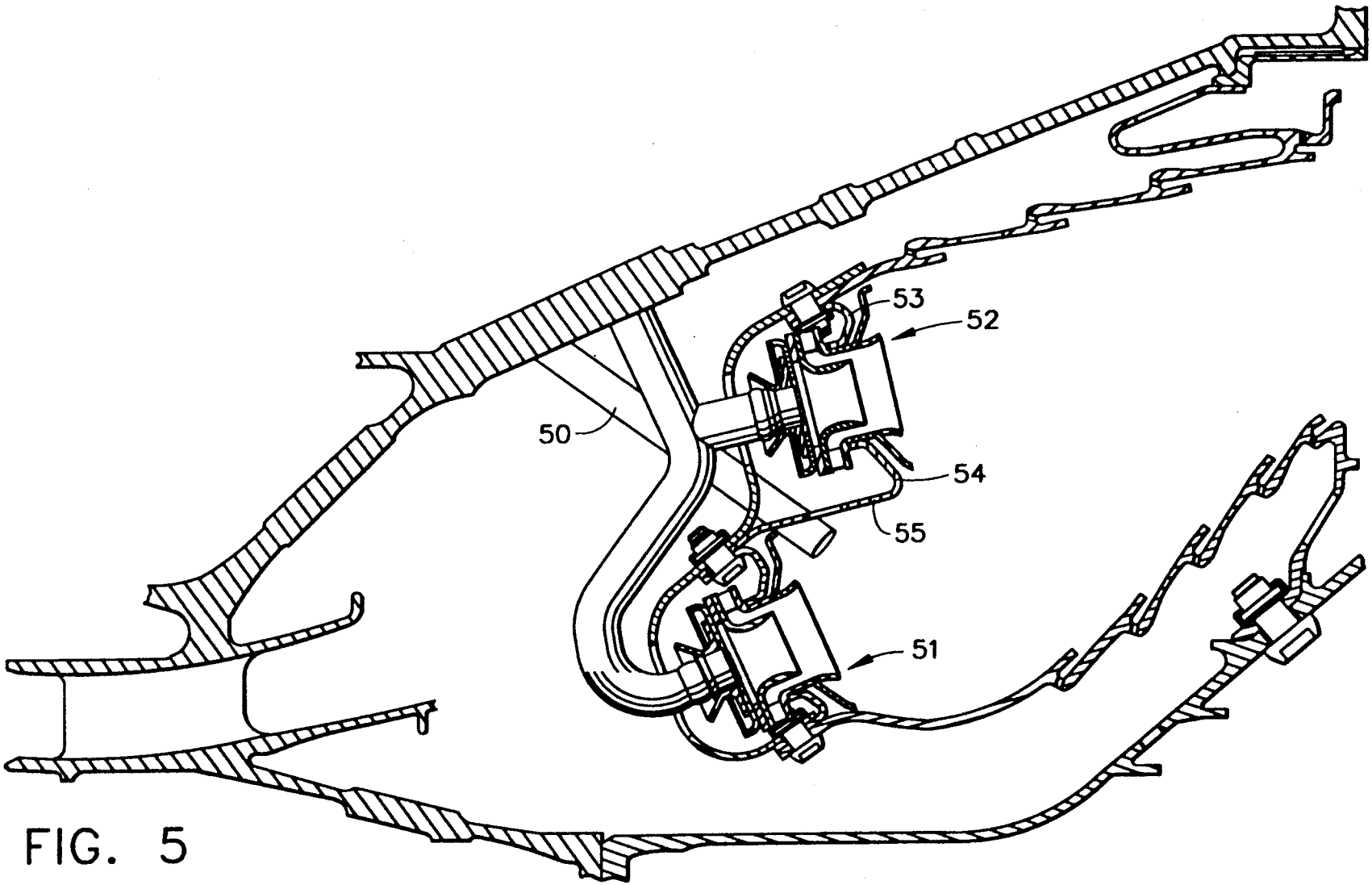
FIG. 5 is an axial cross-sectional view of a double annular combustor in accordance with an alternative embodiment of the invention where the inner annular combustor acts as the pilot stage and the other annular combustor acts as the main stage.

As an alternative embodiment to that shown in FIG. 1, the pilot stage may be the inner annular combustor and the main stage the outer annular combustor. Accordingly, as depicted in FIG. 5, an igniter 50 must be provided to inner annular combustor 51. Because it functions as the pilot stage, inner annular combustor 51 preferably is radially offset upstream of outer annular combustor 52.

Essentially, the embodiment of FIG. 5 is a mirror image of that in FIG. 1, whereby an outer dome plate 53 includes an inner portion 54 having an extended section 55 like that of inner dome plate outer portion 29 in FIG. 1. Otherwise, the elements are the same.

It will be understood that the present invention has been described in terms of particular embodiments, but may take on any number of forms while remaining within the scope and intent of the invention. For example, it will be recognized that the present invention would be applicable to double annular combustors where the inner and stores are radially in-line (axis A and B are parallel) or radially offset. Moreover, as seen in FIGS. 1 and 5, it does not matter whether the inner or outer annular combustor is offset radially downstream (it merely depends on the combustor positioned radially upstream being the pilot stage and the combustor positioned downstream being the main stage for the reasons detailed herein).

Having thus described the invention, what is claimed is novel and desired to be secured by Letters Patent of the United States is:

1. A double angular combustor having concentrical disposed inner and outer annular combustors without a centerbody therebetween, said inner annular combustor lying radially downstream of said outer annular combustor, comprising:

(a) a first dome plate having an inner portion and an outer portion;

(b) a second dome plate having an inner portion and an outer portion;

(c) a cowl structure having an inner portion, an outer portion, and a middle portion, said cowl outer portion being connected to said second dome plate outer portion, is cowl inner portion being connected to said first dome plate inner portion, and said cowl middle portion being connected to said first dome plate outer portion and said second dome plate inner portion; and (d) said first dome plate outer portion including a section extending upstream to said cowl middle portion to form a sheltered region for said outer annular combustor.

2. The double annular combustor of claim 1, wherein said second dome plate inner portion, said first dome plate outer portion, and said cowl middle portion are all connected together.

3. The double annular combustor of claim 1, wherein said first dome plate outer portion is sandwiched between said cowl middle portion and said second dome plate inner portion.

4. The double annular combustor of claim 1, wherein said extended section of said first dome plate outer portion is substantial parallel to an axis extending through said inner annular combustor.

5. The double annular combustor of claim 4, wherein said extended section of said first dome plate outer portion includes a plurality of holes therethrough for cooling said extended section.

6. The double annular combustor of claim 4, wherein said extended section of said first dome plate outer portion includes a plurality of holes therethrough for allowing dilution air into said outer annular combustor.

7. The double annular combustor of claim 5, wherein said extended section of said firs dome plate outer portion further includes a plurality of holes therethrough for allowing dilution air into said outer annular combustor, said dilution holes being substantially larger than said cooling holes.

8. The double annular combustor of claim 7, wherein there is a substantially greater number of cooling holes than dilution holes.

9. The double annular combustor of claim 1, wherein said cowl structure is a single piece.

10. The double annular combustor of claim 3, wherein said connection of said second dome plate inner portion, said first dome plate outer portion, sand said cowl structure middle portion occurs substantially parallel to an axis extending through said outer annular combustor.

11. The double annular combustor of claim 4, wherein said cowl middle portion is curved to extend downstream to accommodate the radial offset between said inner and outer annular combustors.

* * * * *